US007075509B2

(12) United States Patent
Minami

(10) Patent No.: US 7,075,509 B2
(45) Date of Patent: Jul. 11, 2006

(54) CONTROL CIRCUIT AND LIQUID CRYSTAL DISPLAY USING THE CONTROL CIRCUIT

(75) Inventor: Akihiro Minami, Kumamoto (JP)

(73) Assignee: Advanced Display Inc., Kumamoto (JP)

( * ) Notice: Subject to any disclaimer, the term of this patent is extended or adjusted under 35 U.S.C. 154(b) by 485 days.

(21) Appl. No.: 10/667,520

(22) Filed: Sep. 23, 2003

(65) Prior Publication Data

US 2004/0070580 A1 Apr. 15, 2004

(30) Foreign Application Priority Data

Oct. 9, 2002 (JP) ..... P2002-296377

(51) Int. Cl.
*G09G 3/36* (2006.01)

(52) U.S. Cl. ..... 345/98

(58) Field of Classification Search ..... 345/87, 345/98–99, 204, 211–212
See application file for complete search history.

(56) References Cited

U.S. PATENT DOCUMENTS 5,563,624 A * 10/1996 Imamura ..... 345/100
5,903,260 A * 5/1999 Imamura ..... 345/211
2002/0021271 A1* 2/2002 Sakamoto ..... 345/87
2002/0024481 A1* 2/2002 Kawabe et al. ..... 345/87
2002/0075248 A1* 6/2002 Morita et al. ..... 345/204
2002/0154103 A1* 10/2002 Tsuda ..... 345/204
2003/0016189 A1* 1/2003 Abe et al. ..... 345/55

FOREIGN PATENT DOCUMENTS

JP 2001-109424 4/2001

* cited by examiner

*Primary Examiner*—Sumati Lefkowitz
*Assistant Examiner*—Rodney Amadiz
(74) *Attorney, Agent, or Firm*—McDermott Will & Emery LLP

(57) ABSTRACT

A control circuit can prevent malfunction of a scan line driving circuit even when any inputted signal is not in normal timing relation due to any cause. The control circuit includes: a counter 11 for counting up to a predetermined count number based on a clock inputted; a comparator arranged at the subsequent stage of the counter to determine whether or not the counter is under counting; and a protection circuit arranged at subsequent stage of the comparator 12 for normalizing a start pulse that starts operation of the scan line driving circuit, even when any input signal of a timing controller is abnormal, by outputting a normalized start pulse 19 via AND gate 18 to which a start pulse 13 generated by the timing controller and an output signal 16 of the comparator 12 are inputted.

4 Claims, 5 Drawing Sheets

CONTROL CIRCUIT AND LIQUID CRYSTAL DISPLAY USING THE CONTROL CIRCUIT

BACKGROUND OF THE INVENTION

1. Field of the Invention

The present invention relates to a control circuit that supplies a control signal to an image signal line driving circuit and a scan line driving circuit that drives a liquid crystal panel (the control circuit is hereinafter referred to as timing controller). The invention also relates to a liquid crystal display using the timing controller.

2. Description of the Related Art

FIG. 4 is a waveform diagram showing main input/output waveforms when a timing controller of a conventional liquid crystal display is under normal operation.

FIG. 5 is a waveform diagram showing input/output waveforms when the timing controller of the conventional liquid crystal display is under abnormal operation. FIG. 5 shows an example of a signal in a case where the timing controller generates a signal that may break down a power circuit of the liquid crystal display due to any drive different from normal drive in the circuit arranged on the input side of the timing controller or due to any malfunction.

In FIGS. 4 and 5, axis of ordinates of each waveform indicates voltage, and axis of abscissas indicates time. In the drawings, image data supplied to picture elements of liquid crystal panel are omitted.

Referring to FIG. 4, numerals 1*a* to 3*a* designate signals inputted to a timing controller. Reference numeral 1*a* designates a horizontal synchronizing signal (HD) used as a reference signal for synchronizing the liquid crystal display in horizontal direction. Numeral 2*a* designates a vertical synchronizing signal (VD) used as a reference signal for synchronizing the liquid crystal display in vertical direction. Numeral 3*a* designates a data enable signal (DENA) showing a period during which the image data are effective. Further, numerals 4*a* to 8*a* designate signals outputted by the timing controller, numerals 4*a* to 6*a* designate signals for controlling the image signal line driving circuit, and numerals 7*a* to 8*a* designate signals for controlling scan line driving circuit. Numeral 4*a* designates a start pulse (STH) that indicates a start of image data in horizontal direction, and numeral 5*a* designates a polarity inversion signal (POL) for inverting polarity of liquid crystal drive. Numeral 6*a* designates a latch pulse (LP) for transferring image data to an output side of the image signal line driving circuit. Clocks used for signal processing in the image signal line driving circuit and the timing controller are omitted herein. Further, numeral 7*a* designates a clock (CLKV) for signal processing in the scan line driving circuit, and numeral 8*a* designates a start pulse (STV) that indicates start of vertical scanning in the scan line driving circuit.

In FIG. 5, numerals 1*b* to 8*b* designate signals respectively corresponding to numerals 1*a* to 8*a* in FIG. 4.

Additionally, the image signal line driving circuit is normally cascade-connected, and in which the start pulse (STH) signal is delivered sequentially to an adjacent circuit for picture elements, thus control being made for each scan line.

The scan line driving circuit is likewise normally cascade-connected, and in which the start pulse (STV) signal is sequentially delivered to an adjacent circuit for scan lines, thus control being made for each scan line.

The output signals 4*a* to 8*a* are normally generated in the timing controller on the basis of inputted signals 1*a* to 3*a*. Therefore, as long as the inputted signals 1*a* to 3*a* are loaded into the timing controller in the timing relation necessary for image display, the timing controller can transmit a normal signal to the image signal line driving circuit and the scan line driving circuit under the normal operating conditions.

However, in the case of any drive different from normal one in the circuit arranged on the input side of the timing controller or any malfunction, otherwise due to any problem in characteristics of transmission line up to transmission of the signal inputted to the timing controller, sometimes the inputted signals 1*a* to 3*a* may get out of normal timing relation. Moreover, the circuit arranged on the input side of the timing controller may transmit any signal getting out of a predetermined specification of the timing controller due to any mistake or error. In this manner, when the input signals 1*a* to 3*a* are inputted in any abnormal timing relation, the output signals 4*a* to 8*a* generated in the timing controller may not be outputted normally or unexpected abnormal waveforms may be outputted.

For example, when signals are inputted at the timing of the inputted signals 1*b* to 3*b* shown in FIG. 5, output signals 4*b* to 8*b* may be outputted. FIG. 5 shows an example that the timing controller outputs irregular waveforms because of irregular signals inputted to the timing controller. It is of course possible to cope with the irregularity, i.e., abnormal output by detecting the irregular waveforms using any other circuit or forcedly changing the display mode, in the case that such irregular relation as input signals 1*b* to 3*b* continues for a long time. However, if the irregular state continues for a very short time displaying one picture or so, it is often the case that such a short time of irregular state is ignored.

In the example shown in FIG. 5, there is few possibility of effecting negatively on a liquid crystal display in most case. However, if signals being in the relation of output signals 7*b* and 8*b* are given to the scan line driving circuit, the scan line driving circuit drives a plurality of scan lines simultaneously. As a result, a considerable load may be imposed on the power circuit for driving liquid crystal panel. In the worst case, the considerable load causes stop and/or breakdown of the power circuit, and there is a possibility that the display of the liquid crystal panel cannot be restored even after the signal has returned to normal operating conditions.

In the Japanese Patent Publication (unexamined) No. 2001-109424 (pages 5 to 8 and 10, FIG. 2),to cope with malfunction in signal due to abnormality in flexible cable for connection between a liquid crystal display control section and a liquid crystal display module, a signal management and control section is arranged in a scanning driver. This arrangement, however, is not a countermeasure to abnormal input signal in the control circuit.

SUMMARY OF THE INVENTION

The present invention was made to solve the above-discussed problems and has a first object of obtaining a control circuit capable of preventing a scan line driving circuit from malfunction even when any inputted signal is not in normal timing relation for any cause.

A second object of the invention is to obtain a liquid crystal display provided with such a control circuit.

To accomplish the foregoing objects, a control circuit according to the invention feeds a control signal based on an input signal to an image signal line driving circuit and a scan line driving circuit both for driving a liquid crystal panel. The control circuit includes: a control signal generating section that generates a control signal containing a start pulse for starting operation of a scan line driving circuit; and a protection circuit that normalizes the start pulse generated by the control signal generating section even when said inputted signal is not normal.

As a result, runaway of start pulse due to abnormality in input signal can be prevented at a reasonable cost.

DESCRIPTION OF THE PREFERRED EMBODIMENTS

Embodiment 1

In this Embodiment 1, a protection circuit is disposed on the output side of the conventional timing controller (control signal generating section), and a start pulse (STV) delivered from the timing controller to a scan line driving circuit is forcedly stopped when a certain clock number is counted. In other words, digital signal waveform is forcedly dropped to a low level.

In this regard, a "certain clock number" means an elapsed time calculated by multiplying by a clock number in accordance with a period thereof, and may be set to a length beyond actually achieved (for example, to a width of high level in digital signal waveform). However, setting to any excessively large length may bring about increasing load on the power circuit, and a counter for counting the certain clock number may be unnecessarily large-sized. Therefore, it will be most desirable to set a clock number as small as possible while satisfying the requirement of the length of STV beyond actually achieved.

Figure 1:
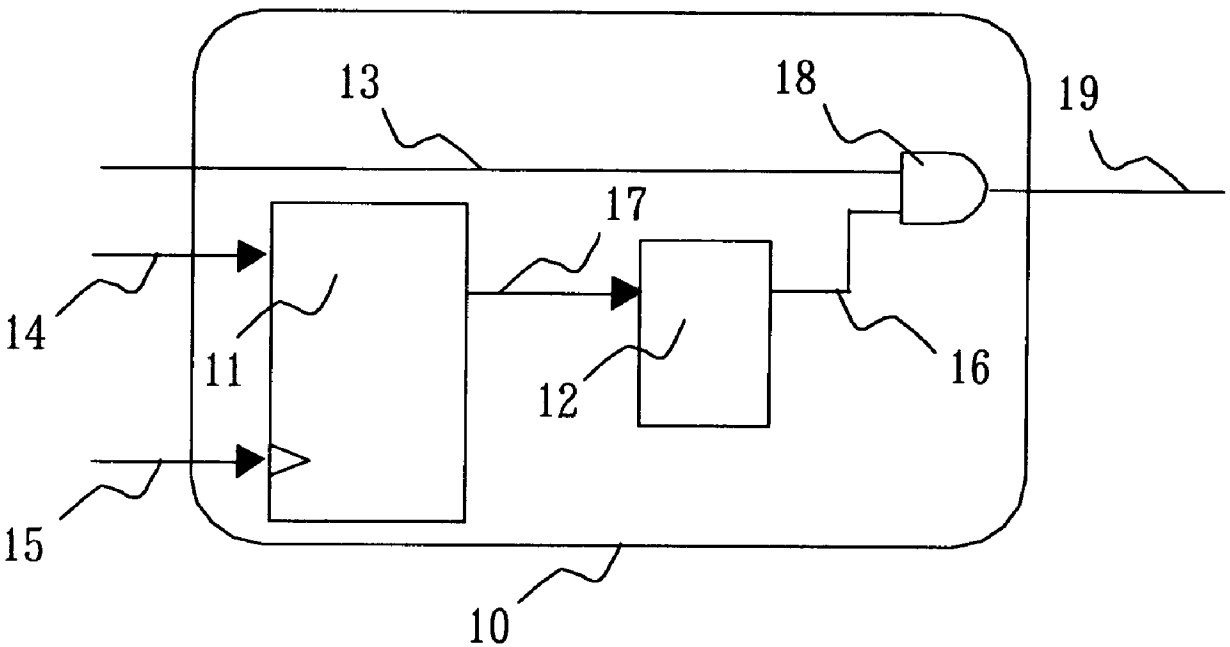
FIG. 1 is a circuit diagram showing a protection circuit of a liquid crystal display according to Embodiment 1 of the present invention.

FIG. 1 is a circuit diagram showing a protection circuit of a liquid crystal display according to Embodiment 1 of the invention.

In FIG. 1, reference numeral 10 is a protection circuit that forcedly stops the STV when a certain clock number is counted. The protection circuit 10 includes a counter 11 and a comparator 12 that determines whether or not the counter 11 is under counting. The counter 11 is located on an output side of the timing controller (control signal generating section), and starts counting at the same time (or at the same clock) as startup of the STV 13 before feeding a signal for protection. For that purpose, it is preferable that the signal used as the trigger signal for startup of the STV 13 may be used as a trigger for start of counting. Numeral 14 is a trigger signal on which the counter 11 starts the counting. When the counter 11 comes to reach a value for counting a certain clock number, the counter 11 is stopped and returned to a reset value.

It is desirable that a clock 15 used in the counter 11 is the same one as used for generating STV 13. An output signal 16 of the comparator 12 is a signal to protect the STV. The comparator 12 outputs a signal of low level when a count value 17 being an output of the counter 11 is a value showing a reset state, while outputting a signal of high level when showing any value other than the reset value, i.e., during counting. The output of the comparator 12 and STV 13 pass through AND gate 18 being a logic element, and finally inputted to the scan line driving circuit as a start pulse 19.

For convenience' sake, the start pulse fed from the timing controller to the scan line driving circuit before passing the protection circuit 10 is indicated by STV 13, and the start pulse after passing the protection circuit 10 is indicated by STV 19.

Figure 2:
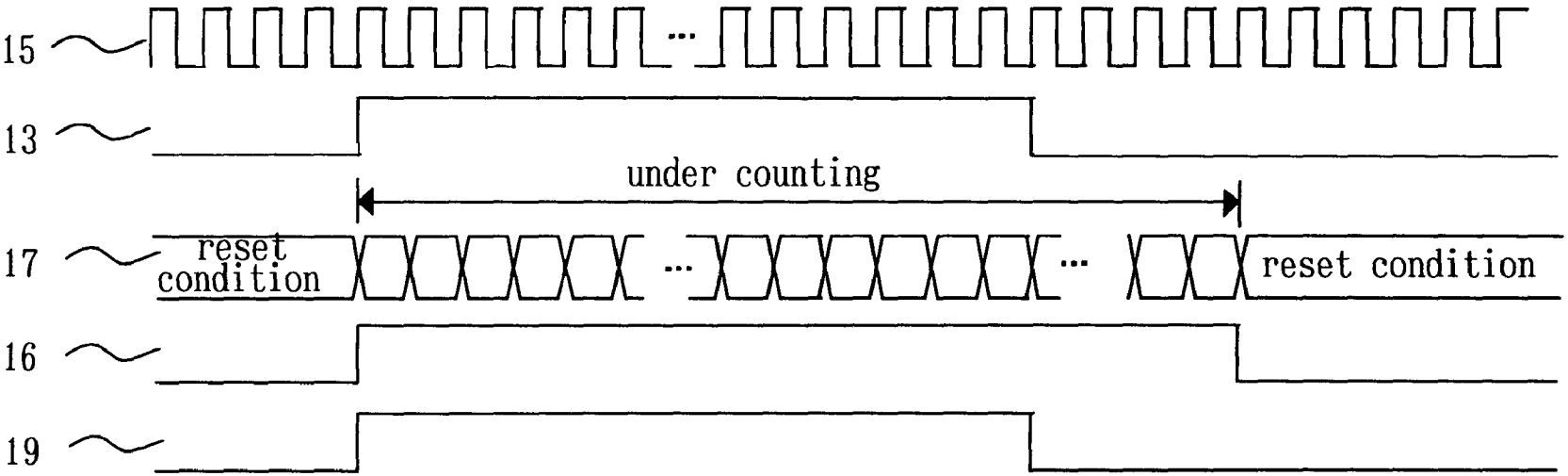
FIG. 2 is a waveform diagram showing waveforms in association with a protection circuit at the time of normal drive of a timing controller of the liquid crystal display according to Embodiment 1 of the invention.

FIG. 2 is a waveform diagram showing waveforms in association with a protection circuit at the time of normal drive of a timing controller of the liquid crystal display according to Embodiment 1 of the invention.

Figure 3:
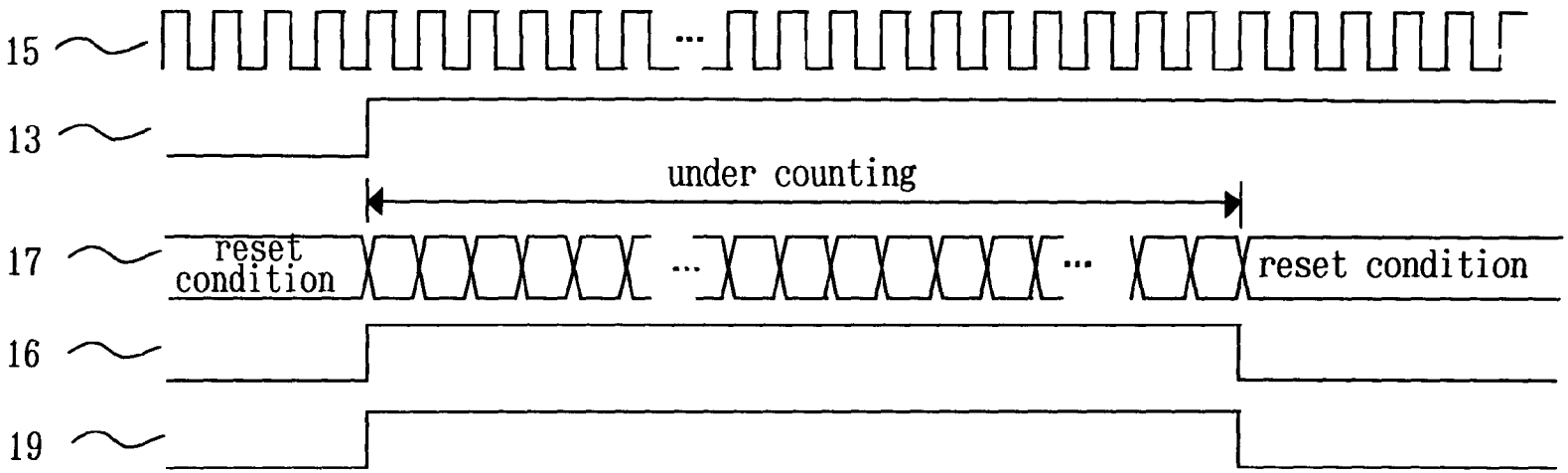
FIG. 3 is a waveform diagram showing waveforms in association with a protection circuit at the time of abnormal drive of a timing controller of the liquid crystal display according to Embodiment 1 of the invention.
Figure 4:
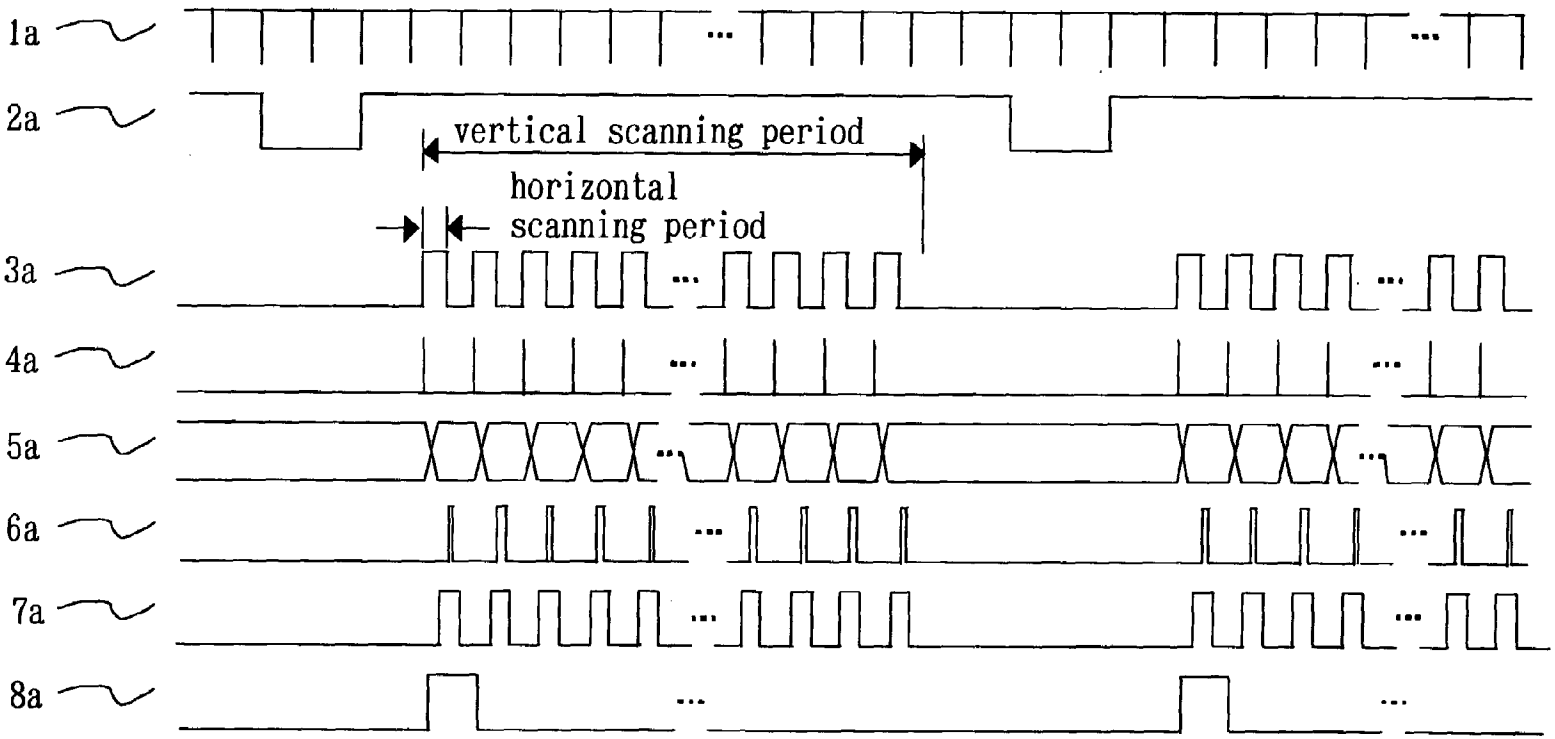
FIG. 4 is a waveform diagram showing input and output waveforms at the time of normal drive of a timing controller for the liquid crystal display according to the prior art.
Figure 5:
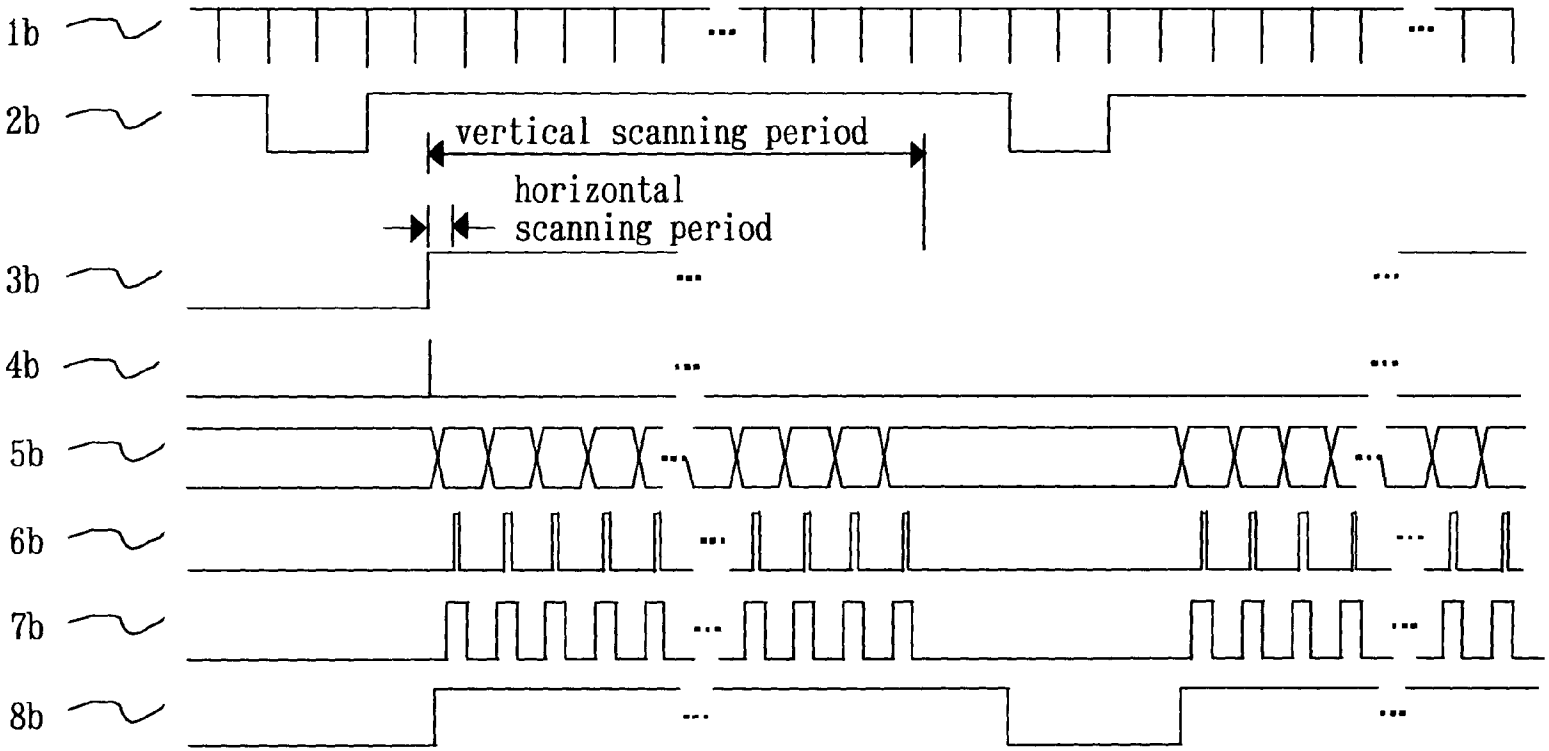
FIG. 5 is a waveform diagram showing input and output waveforms at the time of abnormal drive of a timing controller for the liquid crystal display according to the prior art.

FIG. 3 is a waveform diagram showing waveforms in association with a protection circuit at the time of abnormal drive of a timing controller of the liquid crystal display according to Embodiment 1 of the invention. This diagram shows a case where STV is at high level for an abnormally long time.

In FIGS. 2 and 3, axis of ordinates of each waveform indicates voltage, and axis of abscissas indicates time. Reference numerals 13, 15 to 17, and 19 designate the same parts as in FIG. 1.

Now, operation of the protection circuit is hereinafter described.

Under the normal operation shown in FIG. 2, duration of high level of STV 13 is smaller than that of the output signal 16 of the comparator 12. Accordingly, STV 19 having passed through AND gate 18 of the logic element becomes equal to STV 13 and, therefore, the protection circuit 10 does not give any influence on the STV originally generated.

On the contrary, under the abnormal operation as shown in FIG. 3, duration of high level of STV 13 is longer than that of the output signal 16 of the comparator 12. In this case, STV 19 becomes equal to the output signal 16 and, therefore, any STV 19 of which waveform is longer than the clock number set in the protection circuit 10 is not generated.

Accordingly, the scan line driving circuit minimizes the simultaneous drive of the scan lines even in case of occurrence of any malfunction. Thus, there is no simultaneous drive of a large number of scan lines. As a result, there is no such problem as imposition of any heavy load on the power circuit that drives the liquid crystal display or, in the worst case, occurrence of stop, breakdown or the like in the power circuit. It is possible that, upon the signal returning to the normal timing, the normal display is restored on the liquid crystal display.

When integrating the timing controller and protection circuit into a semiconductor device, the invention can be constituted without increase in cost.

According to this Embodiment 1, by minimizing the runaway of start pulse to the scan line driving circuit due to malfunction for any cause, a large number of scan lines are prevented from being simultaneously driven in the liquid crystal panel. As a result, the power circuit for driving the liquid crystal panel can be prevented from stopping and breakdown.

Further, by integrating into a semiconductor device including the protection circuit, the mentioned advantages can be achieved without increase in cost.

Furthermore, since the power circuit is digitally prevented from being overloaded, it is not required at all to add any circuit acting as a countermeasure to the overload or to increase load drive performance.

Embodiment 2

In the foregoing Embodiment 1, when the start pulse (STV) on the scan line driving circuit is at high level in digital signal, the scan line driving circuit begins signal processing. It is also preferable that the scan line driving circuit begins signal processing at low level.

In this case, the output signal 16 of the comparator 12 in FIG. 1 is brought to a high level when it shows a reset value, and brought to a low level when it shows any value other than the reset value, i.e., during counting. Further, employing OR gate of the logic element in place of AND gate 18 of the logic element achieves the same advantages as in the foregoing Embodiment 1.

In the foregoing Embodiments 1 and 2, the output signal 16 of the comparator starts up simultaneously with (within the same clock as) STV 13, it is also preferable that the output signal 16 starts up a little earlier than STV 13.

In the foregoing Embodiments 1 and 2, STV remaining positive and negative logic is described. The same advantages are also achieved by appropriately selecting the gate located at the final stage, even when the positive and negative logic is inverted in the protection circuit.

In the case of incorporating the protection circuit in FIG. 1 in a semiconductor device, the circuit is preferably located at the previous stage of the output buffer element. It is also preferable to arrange that several flip-flops and gates are interposed between the circuit of FIG. 1 and the output buffer. Such an arrangement renders preferable operation as far as no restriction is imposed on the input timing of the scan line driving circuit.

What is claimed is:

1. A control circuit that feeds a control signal based on an input signal to an image signal line driving circuit and a scan line driving circuit both for driving a liquid crystal panel;

the control circuit comprising:

a control signal generating section that generates a control signal containing a start pulse for starting operation of said scan line driving circuit; and a protection circuit that normalizes said start pulse generated by said control signal generating section in response to said input signal even when said inputted signal is not normal.

2. The control circuit according to claim 1, wherein said protection circuit comprises:

a counter for counting up to a predetermined count number based on a clock inputted;

a comparator arranged at the subsequent stage of said counter to determine whether or not said counter is under counting; and a logic element arranged at the subsequent stage of said comparator to output a start pulse normalized by logical operation of a start pulse generated by said control signal generating section and an output signal of said comparator.

3. The control circuit according to claim 1, wherein said control signal generating section and said protection circuit are integrated into a semiconductor device.

4. A liquid crystal display comprising:

the control circuit as defined in claim 1;

an image signal line driving circuit and a scan line driving circuit both for outputting a drive signal in response to a control signal fed by said control circuit; and a liquid crystal display for displaying an image, which is driven by said image signal line driving circuit and said scan line driving circuit.

* * * * *